US010357821B2

(12) United States Patent
Benedetti et al.

(10) Patent No.: US 10,357,821 B2
(45) Date of Patent: Jul. 23, 2019

(54) STEEL PLANT WITH MULTIPLE CO-ROLLING LINE AND CORRESPONDING METHOD OF PRODUCTION

(71) Applicant: DANIELI & C. OFFICINE MECCANICHE S.P.A., Buttrio (IT)

(72) Inventors: Gianpietro Benedetti, Tricesimo (IT); Giuseppe Bordignon, Bicinicco (IT); Fabrizio Mulinaris, Udine (IT); Alfredo Poloni, Fogliano di Redipuglia (IT)

(73) Assignee: DANIELI & C. OFFICINE MECCANICHE SPA, Buttrio (IT)

( * ) Notice: Subject to any disclaimer, the term of this patent is extended or adjusted under 35 U.S.C. 154(b) by 81 days.

(21) Appl. No.: 15/027,235

(22) PCT Filed: Oct. 3, 2014

(86) PCT No.: PCT/IB2014/065031

§ 371 (c)(1),
(2) Date: Apr. 4, 2016

(87) PCT Pub. No.: WO2015/049663

PCT Pub. Date: Apr. 9, 2015

(65) Prior Publication Data

US 2016/0243611 A1 Aug. 25, 2016

(30) Foreign Application Priority Data

Oct. 4, 2013 (IT) ..... UD2013A0128

(51) Int. Cl.
*B22D 11/14* (2006.01)
*B22D 11/04* (2006.01)
(Continued)

(52) U.S. Cl.
CPC ..... *B22D 11/147* (2013.01); *B21B 1/46* (2013.01); *B22D 11/041* (2013.01);
(Continued)

(58) Field of Classification Search
CPC ..... B22D 11/04; B22D 11/041; B22D 11/103; B22D 11/14; B22D 11/141; B22D 11/147;
(Continued)

(56) References Cited

U.S. PATENT DOCUMENTS 3,930,395 A * 1/1976 Bretschneider et al. ..... B21B 1/18 72/228
5,636,543 A * 6/1997 Kajiwara et al. ..... B21B 1/26 72/234
(Continued)

FOREIGN PATENT DOCUMENTS

DE 101 09 223 C1 8/2002
EP 0 770 433 A1 5/1997
(Continued)

OTHER PUBLICATIONS

International Search Report and Written Opinion for PCT/IB2014/065031, dated Dec. 17, 2014.

*Primary Examiner* — Kevin P Kerns
(74) *Attorney, Agent, or Firm* — Marshall, Gerstein & Borun LLP

(57) ABSTRACT

A steel plant for the production of long metal products includes a continuous casting machine and a rolling mill disposed contiguous and in direct succession downstream of the continuous casting machine. The continuous casting machine is provided with at least two casting lines and the rolling mill is provided with at least two rolling lines. The plant includes a single feed apparatus for feeding molten
(Continued)

metal, and the at least two casting lines are configured to receive molten metal from the single feed apparatus.

10 Claims, 4 Drawing Sheets

(51) Int. Cl.

| | |
|---|---|
| ***B22D 11/10*** | (2006.01) |
| ***B21B 1/46*** | (2006.01) |
| ***B22D 11/103*** | (2006.01) |
| ***B22D 11/041*** | (2006.01) |
| *B21B 13/22* | (2006.01) |
| *B21B 15/00* | (2006.01) |

(52) U.S. Cl.
CPC ..... *B22D 11/103* (2013.01); *B22D 11/141* (2013.01); *B21B 1/463* (2013.01); *B21B 1/466* (2013.01); *B21B 13/22* (2013.01); *B21B 2015/0014* (2013.01); *B22D 11/04* (2013.01)

(58) Field of Classification Search
CPC ..... B21B 1/46; B21B 1/463; B21B 1/466; B21B 13/22; B21B 2015/0014
USPC ..... 164/476, 417, 454, 413; 29/527.7
See application file for complete search history.

(56) References Cited

U.S. PATENT DOCUMENTS

| | | | | |
|---|---|---|---|---|
| 5,727,127 | A * | 3/1998 | Schulze Horn et al. | ..... B22D 11/16 706/47 |
| 6,044,895 | A * | 4/2000 | Kuttner et al. | ..... B22D 11/06 164/154.4 |
| 2004/0079512 | A1 | 4/2004 | Hohenbichler et al. | |
| 2012/0006502 | A1 | 1/2012 | Bausch et al. | |

FOREIGN PATENT DOCUMENTS

| | | | | |
|---|---|---|---|---|
| JP | 55-112105 | 8/1980 | | |
| JP | 56-45201 | 4/1981 | | |
| JP | 2007-319872 A | * 12/2007 | | ..... B21B 3/00 |

* cited by examiner

STEEL PLANT WITH MULTIPLE CO-ROLLING LINE AND CORRESPONDING METHOD OF PRODUCTION

FIELD OF THE INVENTION

The present invention concerns a steel plant and corresponding method for making long metal products such as bars, round pieces for reinforced concrete, wire rods, beams or other profiles usable for example in mechanical or civil engineering.

In particular, the present invention concerns a combined casting and rolling plant, for the direct rolling of semifinished continuous cast products according to processes defined as "endless" and "semi-endless".

BACKGROUND OF THE INVENTION

It is known that long metal products, that is having a predominant longitudinal size with respect to the cross section, are normally produced by rolling long semifinished products deriving from continuous casting of the metal, for example steel.

The finished products are generally bars, round pieces for reinforced concrete, rods, beams or other profiles, obtained by transforming billets or blumes, with a square, rectangular or round section.

Steel plants are known for the production of long products in which a rolling mill is connected to a continuous casting machine downstream of the latter in a work direction.

In these known plants, a rolling line is located downstream of a continuous casting line, and can be for example aligned and directly coupled with it, defining a co-rolling line, thus without providing intermediate devices, transfer devices, shuttles, translating planes, mobile rollerways or other, which actively move the cast metal, for example translating it in directions transverse to the work direction.

These known plants can perform a production process with no solution of continuity, also known as "endless", in which there is only one semifinished continuous cast product which extends from the zone where the liquid steel solidifies to a zone where it enters into the rolling mill.

The single semifinished product is rolled progressively along the rolling line downstream of the continuous casting line, allowing to reduce the number of entrances over all the stands of the rolling train and hence the probability of cobbles occurring, thus allowing high productivity.

The known combined plant also allows to reduce the compression powers needed in the first portion of the rolling mill, and to exploit the high temperature of the semifinished cast product and to reduce the quantity of cropping cuts, allowing to contain operating costs thanks to increased yield.

Furthermore, a plant provided with a co-rolling line can also perform a semi-endless production process, in which, instead of a single continuous semifinished product, the rolling mill receives, from the continuous casting, material defined by a discrete succession of semifinished products, sheared to size by a shearing unit.

The shearing unit can be used in the starting and stopping phases of the casting machine, for example to perform the head and tail cropping, or when there is a stoppage of the rolling mill, for example following a maintenance intervention or equipping of the plant, or following a cobble or other problem or inconvenience.

In such situations, where the rolling mill is not able to receive material to be rolled, semifinished cast products are produced, using the shearing unit as above, which have a certain pre-established length and which are then sent to storage areas to be subsequently worked in the rolling mill, once it has been returned to service.

Plants are also known in which two casting lines feed a rolling line downstream of the casting machine and work with a semi-endless process.

With the aim of producing competitive products, there is a strongly felt need to increase the productivity of steel plants, and also to contain waste and energy consumption in order to increase the yield and reduce production costs.

Known combined continuous casting and rolling plants can be limited in this sense, since they are unable to satisfy this requirement, and are greatly affected by stoppages, either programmed or accidental, of the rolling mill.

This limitation as above is particularly important especially in the case of steel plants with a single co-rolling line, in which any delay or problem in rolling can cause the slow-down or stoppage of the continuous casting machine upstream and, consequently, also of the whole steel works served by each steel plant.

Furthermore, if an increase in hourly productivity is required from the mono-line steel plant, this increase can be obtained only by increasing the casting speed. Increasing the casting speed has a technological limit, however, determined for each continuous casting machine and for each type of product, by the fact that too high speeds penalize the castability of the semifinished cast product, even making it impossible, and also compromise the quality thereof, with consequent negative effects on the rolling process and hence on the quality of the finished product.

U.S. 2004/079512 A1, JP S56 45201 A and JP S55 112105 A describe multiple line continuous casting plants. US 2004/079512 A1 proposes a solution in which two rolling lines disposed angled with respect to each other, for example by 90°, are fed by a respective casting device with twin rolls fed by a tundish connected to a double ladle rotatable device. JP S56 45201 A and JP S55 112105 A describe solutions with a double casting and roughing line, which converge in a single intermediate rolling and finishing train, a system being provided to control the loop between the roughing rolling stands and the intermediate and finishing rolling stands.

One purpose of the present invention is to obtain a combined continuous casting and rolling plant, and the corresponding method, for the production of long metal products that guarantee high productivity and reduce to a minimum the spaces occupied.

Another purpose of the present invention is to exploit to the utmost the cycle of the steel plant upstream, minimizing the number of movements necessary to feed the casting machines located downstream.

Another purpose of the present invention is to maximize the yield of the plant and the corresponding method, reducing to a minimum the discards of material during the working process.

Another purpose of the present invention is to exploit to the maximum the enthalpy possessed by the original liquid steel, in particular of the semifinished continuous casting products, to contain the running costs and the energy consumption of the plant.

Furthermore, another purpose of the present invention is to obtain a steel plant and a corresponding method of production for the production of long metal products that is flexible, so that it is possible to perform for example a plurality of production steps adaptably to a plurality of different functioning conditions or type of product to be made.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

In accordance with the above purposes, a steel plant according to the present invention, which overcomes the limits of the state of the art and eliminates the defects present therein, comprises a continuous casting machine and a rolling mill disposed downstream of the continuous casting machine, contiguous and in direct succession thereto.

According to a characteristic feature of the present invention, the continuous casting machine is provided with at least two casting lines and the rolling mill is provided with at least two rolling lines, wherein each casting line is aligned with a respective rolling line, defining overall at least two co-rolling lines disposed adjacent along respective work directions. The steel plant also comprises a single apparatus for feeding the molten metal, and the at least two casting lines are configured to receive molten metal from it.

In this way the advantage is obtained that it is possible to produce long metal products by direct rolling of semifinished cast products, continuously and with no solution of continuity with two independent co-rolling lines, each having both a first part dedicated to continuous casting, and also a second part dedicated to rolling. Furthermore, according to the invention, the at least two co-rolling lines are advantageously close together, at least in said first part, given the presence of the single feed apparatus.

It is therefore possible to obtain high productivity, even in the range for example of 150 t/h when both co-rolling lines are active simultaneously.

According to some features of the present invention, the co-rolling lines can be parallel to each other along the whole extension from the casting machine to the rolling mill.

According to other features of the present invention, the co-rolling lines can be reciprocally inclined, for example divergent, with respect to a common median axis. This inclination, for example divergence, according to the invention, can affect even only one part of the co-rolling lines.

In some forms of embodiment of the present invention, the co-rolling lines are distanced from each other, in correspondence with said feed apparatus, by a distance defining a first interaxis between the casting lines.

According to some features of the present invention, the co-rolling lines are distanced from each other, in correspondence with the terminal part of the rolling mill, by a distance defining a second interaxis, greater than the first interaxis.

The second interaxis, according to the invention, has a length that exceeds the length of the first interaxis at least by 100%, up to as much as 300% or more.

In this way the advantage is obtained that it is possible to contain the overall width of the steel plant, reducing to a minimum the interaxes between the co-rolling lines, compatibly with the needs of positioning and moving the casting and rolling apparatuses.

According to some features of the present invention, the steel plant comprises at least a central management unit connected at least to an extractor unit of each of the at least two casting lines, and to a device to regulate the stream of molten metal from the feed apparatus to a corresponding crystallizer of each casting line.

The central management unit is configured to control independently and autonomously at least each extractor unit and each regulation device, to selectively vary the casting speed of each casting line, independently and autonomously with respect to the at least one other casting line.

Consequently, the advantage is obtained of great flexibility of the steel plant according to the present invention, which allows an independent management of the casting lines and consequently allows to obtain different products from one line and the other, and to regulate the productivity of the two co-rolling lines depending on the requirements of the plant. It is therefore possible to keep the casting speeds optimized, and consequently the rolling speeds, so as to always obtain, in any condition of production requirement, the best quality of the finished product.

It is also possible, thanks to the presence of the two independently managed co-rolling lines, to equip one casting line or one rolling line, while the other casting line or rolling line can proceed with its operations. Furthermore, obligatory stoppages of one of the two co-rolling lines can be carried out individually without stopping the production of the entire steel plant, as would happen in the case of a mono-line. In particular, if the rolling mill of one of the two co-rolling lines is stopped for maintenance or due to a cobble, the plant can function in two alternative ways:

a) The functioning line continues working normally, while the one with the rolling mill stopped continues to cast, producing billets that instead of being sent to the respective rolling mill are sheared to the desired length and discharged laterally downstream of the casting machine; in this way the cycle of the steel plant upstream remains unchanged;

b) The production of the steel plant upstream is halved and only the functioning line is fed.

The present invention also concerns a method for the production of long metal products, comprising continuous casting and rolling downstream of the continuous casting, which provides to supply molten metal from a single feed apparatus to the at least two adjacent co-rolling lines in respective work directions, to cast the molten metal along at least two adjacent casting lines and, with no solution of continuity, to roll the cast metal received from the two casting lines along at least two adjacent rolling lines of the co-rolling lines.

BRIEF DESCRIPTION OF THE DRAWINGS

These and other characteristics of the present invention will become apparent from the following description of some forms of embodiment, given as a non-restrictive example with reference to the attached drawings wherein.

Figure 1:
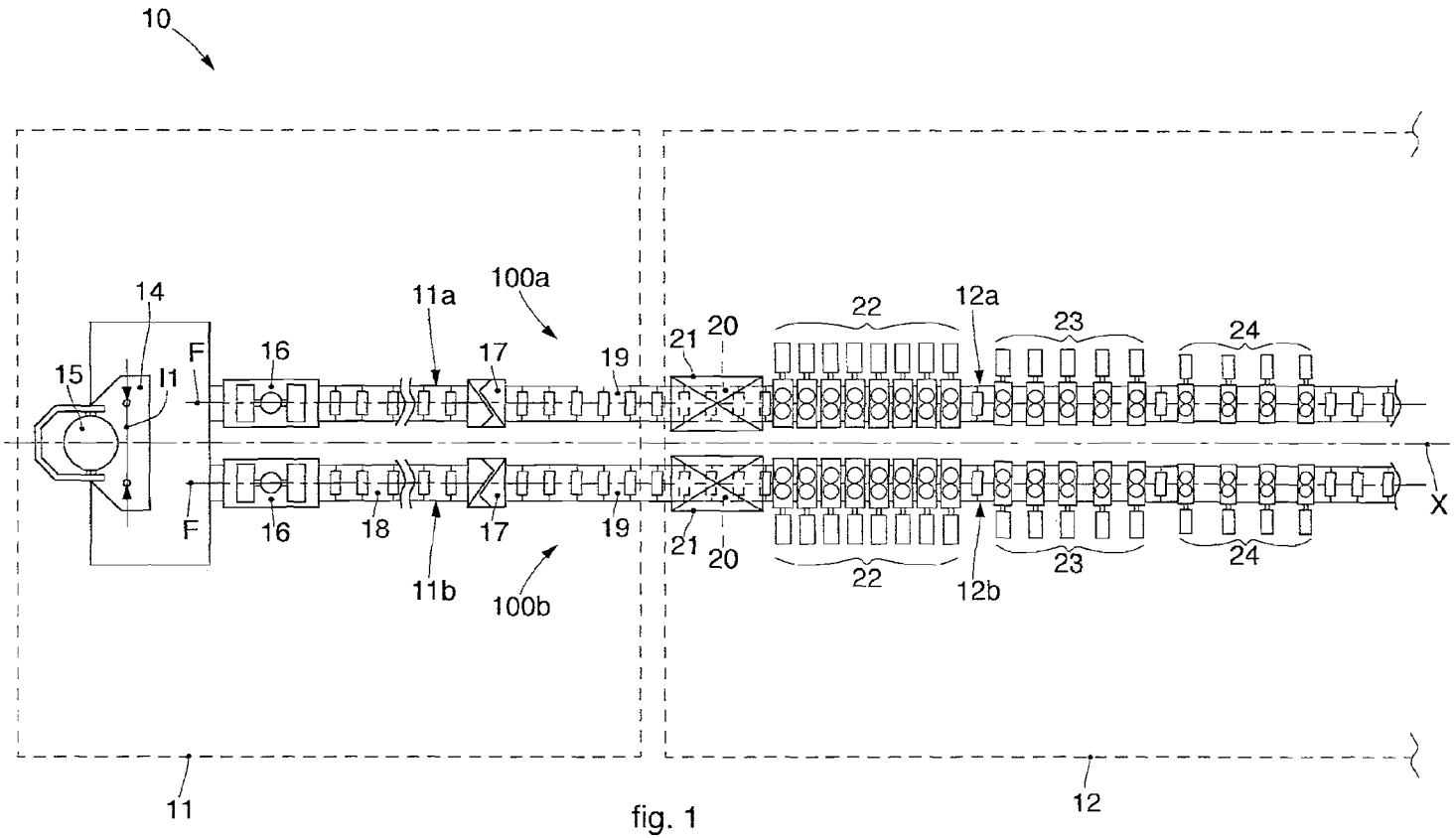
FIG. 1 is a schematic plan view of some forms of embodiment of a steel plant according to the present invention.

In the following description, the same reference indicate the same parts of the steel plant according to the present invention, also in different forms of embodiment. It is understood that elements and characteristics of one form of embodiment can be conveniently incorporated into other forms of embodiment without further clarifications.

DETAILED DESCRIPTION OF A PREFERENTIAL FORM OF EMBODIMENT

We shall now refer in detail to the various forms of embodiment of the present invention, of which one or more examples are shown in the attached drawings. Each example is supplied by way of illustration of the invention and shall not be understood as a limitation thereof. For example, the characteristics shown or described insomuch as they are part of one form of embodiment can be adopted on, or in association with, other forms of embodiment to produce another form of embodiment. It is understood that the present invention shall include all such modifications and variants.

With reference to the attached drawings, a steel plant with a multiple co-rolling line for the production of long metal products according to the present invention is indicated in its entirety by the reference number 10.

According to the present description, the expression "co-rolling line" means that a casting line is aligned, that is, in axis, with respect to the respective rolling line downstream, or at least with respect to an initial segment of the rolling line, therefore without any intermediate devices, transfer devices, shuttles, translating planes, mobile rollerways or other, which actively move the cast product, for example translating it in directions transverse to a working and advance direction.

According to the present description, moreover, the steel plant is configured to effect the solidification of the metal, for example liquid steel, in semifinished cast pieces and to produce long metal products starting from said semifinished products.

The semifinished products can be blumes or billets with a circular, rectangular square or polygonal section, typically used for the production of bars, round pieces, rods, profiles, or they can also be beam-blanks with a substantially H-shaped section for the production of beams or profiles.

Hereafter in the description and possibly in the claims, we shall use the word "billet" to identify any one whatsoever of the semifinished continuous casting products mentioned above.

In some forms of embodiment, the steel plant 10 can reach, for sections worked at maximum speeds, an hourly productivity of about 150 t/h of rolled products, and can even exceed 1-1.5 Mt annual productivity.

The steel plant 10 according to the present invention includes a continuous casting machine 11 and a rolling apparatus or rolling mill 12, positioned downstream of the continuous casting machine 11.

The continuous casting machine 11 and the rolling mill 12 are contiguous and located one in succession to the other in a work direction, or flow direction.

According to the present description, the expression "work direction F" can identify the direction and sense of the stream of the material, during the casting and rolling process made in a co-rolling line of the steel plant 10.

In forms of embodiment described using FIG. 1, the work direction of each co-rolling line is indicated for example by the axis F.

In other example forms of embodiment, described with reference to FIGS. 3 and 4, different work directions can be present, for example reciprocally inclined, indicated in FIGS. 3 and 4 by the axes Fa and Fb.

In some forms of embodiment, the continuous casting machine 11 and the rolling mill 12 also share the same work direction F, so that the semifinished cast products can be received directly by the respective rolling mill 12. In this way, it is possible to achieve a co-rolling process without a solution of continuity, or endless, from casting the liquid steel to obtaining the long metal products. In the endless process, the expression "semifinished cast product" means a single billet, having a length that goes from the exit of the crystallizer of the continuous casting machine 11 to the entrance to the rolling mill 12.

The steel plant 10 is also suitable to effect a semi-endless co-rolling process, or billet-by-billet, in which the semifinished cast products are fed to the rolling mill 12 with a partial solution of continuity. In the semi-endless process, the rolling mill 12 is fed with segments of billet of a desired length, for example comprised between 12 m and 80 m.

In some forms of embodiment, combinable with all the forms of embodiment described here, the steel plant 10 also includes one or more transfer ways 19 which connect the casting machine 11 to the rolling mill 12.

The attached drawings are used to describe forms of embodiment of the steel plant 10 in which the continuous casting machine 11 is provided with at least two casting lines, for example a first casting line 11*a* and a second casting line 11*b*, autonomous and independent with respect to each other.

To contain the spaces occupied by the steel plant 10, at least in the zone affected by the continuous casting machine 11, upstream of the two casting lines 11*a*, 11*b*, a single apparatus may be provided to feed the molten metal, common to both casting lines 11*a*, 11*b*, such as a single tundish 14, to which the two co-rolling lines 100*a*, 100*b* of the steel plant 10 described here refer. From the single common tundish 14, both the first casting line 11*a* and the second casting line 11*b* can depart.

Liquid steel may be cast, for example continuously, into the tundish 14 from ladles 15, which follow each other, typically in a cycle time or tap-to-tap time of the melting furnace, which substantially marks the operating time of a whole steel works and consequently also of the steel plant 10.

According to the present description, the expression "plant axis X" identifies the axis passing through the center of the common tundish that divides the lying planes of the two co-rolling lines.

In possible forms of embodiment, the two casting lines 11*a*, 11*b* can be disposed in a parallel geometry to each other and for example also parallel to the plant axis X, that is, having the respective work directions indicated by the axes F that are parallel to each other, as for example described using FIG. 1. In other possible forms of embodiment, the two casting lines 11*a*, 11*b* can be disposed slightly inclined, that is, with the respective work directions indicated by the axes Fa and Fb which are inclined, in particular diverging from each other (see for example FIGS. 3 and 4), with reference to a theoretical median axis, for example defined by the plant axis X, as will be explained in more detail hereafter in the description.

In some forms of embodiment, each of the two casting lines, first 11*a* and second 11*b*, can also include an extractor unit 16 configured to extract the solidifying billets from the ingot mold continuously and simultaneously, in the case for example of the two casting lines 11*a* and 11*b*.

Proceeding in the work directions indicated by axes F (for example FIG. 1), Fa and Fb (for example FIGS. 3 and 4), the billets in the casting machine 11 are progressively solidified, generally by means of forced cooling, for example by water or air-water.

The casting machine 11 can include, for example for each casting line 11*a*, 11*b*, a shearing unit 17, which is configured to intervene, for example, in a semi-endless production process or, for example, in the endless production process if emergencies occur, such as for example a cobble in the rolling mill 12, so that it is necessary to interrupt the rolling process.

The shearing unit 17, which can be the mechanical type, for example a shears, or thermo-chemical, for example an oxyacetylene system with oxyacetylene blow torches, is configured to shear the billets to size, obtaining billets with a pre-determined length, for example from 12 to 16 meters, but also up to 80 meters, suitable to allow them to be stored and subsequently rolled.

Each shearing unit 17 is positioned at the end of a corresponding intermediate transfer way, for example a rollerway 18, which joins the extractor unit 16 and the shearing unit 17.

In some example forms of embodiment, it may be provided that to each casting line 11*a*, 11*b* a corresponding rolling line 12*a*, 12*b* is respectively aligned, along the plant axis X. In this way, the first casting line 11*a* and the first rolling line 12*a* define a first co-rolling line 100*a*, while the second casting line 11*b* and the second rolling line 12*a* define a second co-rolling line 100*b*. It is therefore possible that, under normal working conditions, the rolling mill 12 rolls the billets directly and without any solution of continuity. In the endless process, the steel plant can process for example a single billet for each co-rolling line 100*a*, 100*b*, and the single billet can extend from the initial part of the continuous casting machine 11 until at least an intermediate part of the rolling mill 12.

Figure 3:
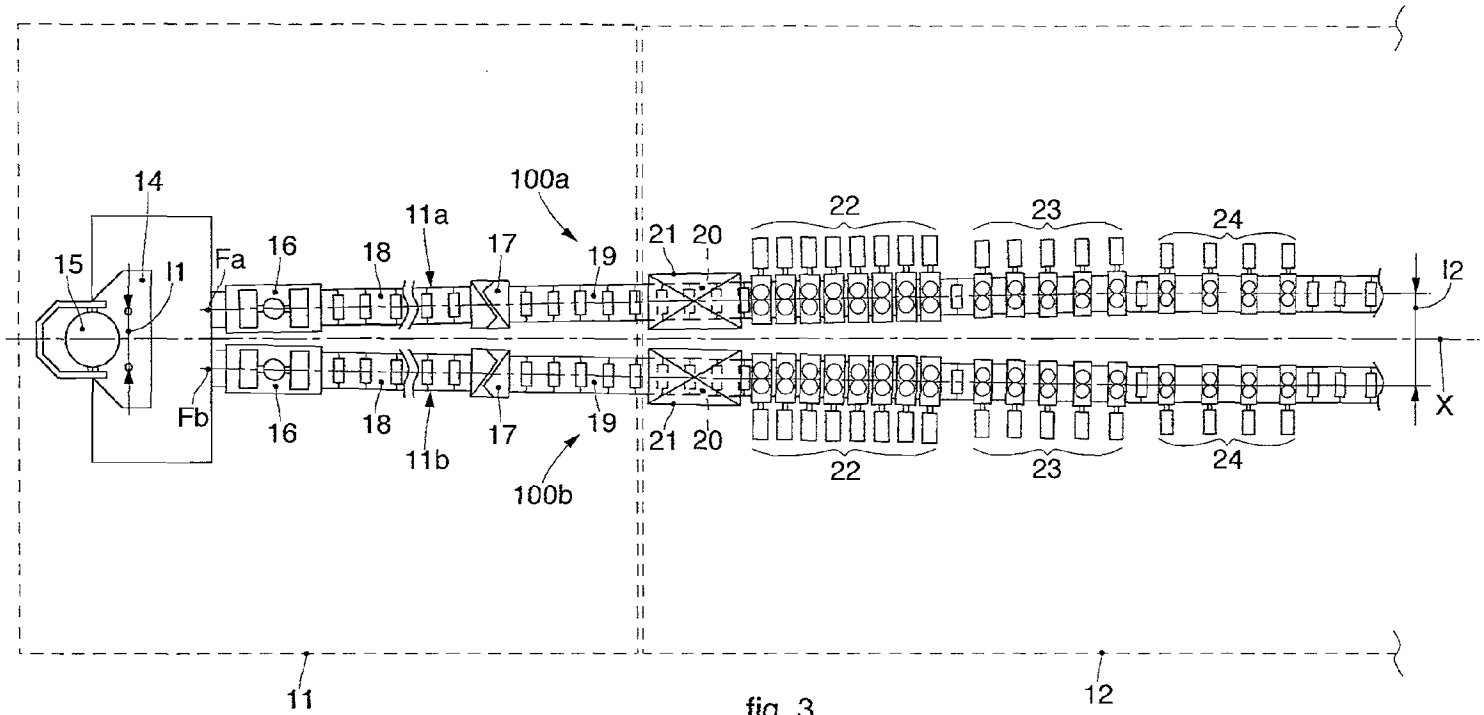
FIG. 3 is a variant of FIG. 1.
Figure 4:
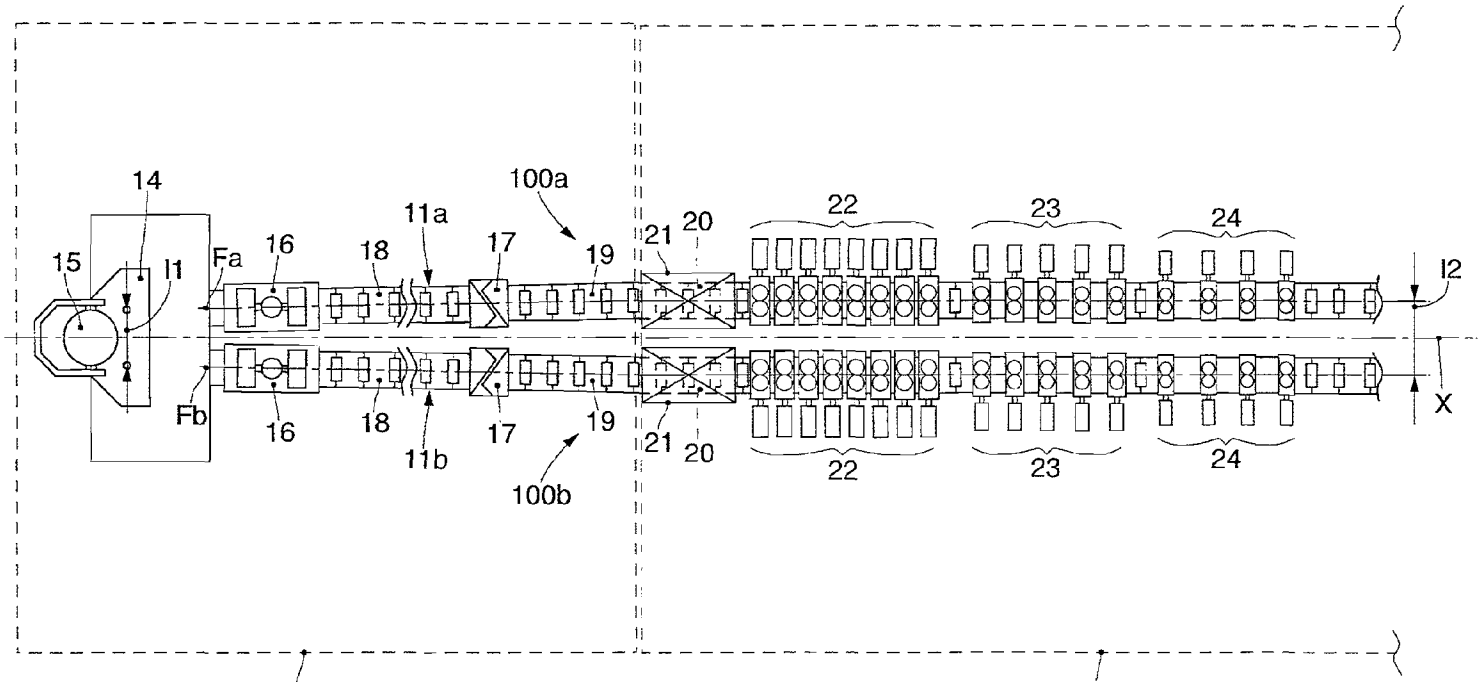
FIG. 4 is a variant of FIG. 3.

With reference to the example forms of embodiment described using FIGS. 1, 3 and 4, for each co-rolling line 100*a*, 100*b* a transfer path 19 can be provided, for example with rolls, configured to connect the continuous casting machine 11 to the rolling mill 12, partly included in the continuous casting machine 11 and partly in the rolling mill 12.

The transfer path 19 can be interposed for example between the intermediate transfer path 18 and a roughing train 22 of the rolling mill 12, in which the first deformations of the billet are performed, that is, typically, those that require greatest power. Typically, the roughing train 22 can define a preliminary working zone of the rolling mill 12, upstream of the finishing, as explained in more detail hereafter.

The transfer path 19 can include a terminal part that functions as a feed segment 20 inside the rolling mill 12.

In the event, for example, that the steel plant 10 is functioning normally in an endless process, the billet arriving from the intermediate transfer path 18 of the continuous casting machine 11 can be drawn along the transfer path 19 and can be moved through rapid heating devices, such as for example one or more induction furnaces 21, present in correspondence with said feed segment 20.

When, on the contrary, the rolling mill 12 is unable to receive material from the continuous casting machine 11, for example in the event of stoppages in the rolling to perform programmed maintenance of the rolling mill 12, or equipping to change the sections to be produced, or again in the case of accidental events, such as cobbles or malfunctioning, the shearing unit 17 can be activated and can intervene for the production of billets in segments of a predefined length.

In the event, for example, of semi-endless or discontinuous functioning, the induction furnaces 21 receive billets in segments.

In any case, the induction furnaces 21, typically located upstream of the roughing train 22, can for example be configured to heat the billet up to a start-of-rolling temperature, normally comprised between 1050° C. and 1200° C.

In some forms of embodiment, downstream of the roughing train 22, the rolling mill 12 includes an intermediate rolling train 23 which is configured to shape the product exiting from the roughing train 22 in successive deformation passes that allow to obtain a product with an intermediate cross section between the final cross section of the rolled product and the initial cross section of the cast billet.

Downstream of the intermediate train 23, the rolling mill 12 includes a finishing rolling train 24, which is configured to perform one or more rolling operations for finishing and obtaining the final rolled product.

The rolling mill 12 can also include, downstream of the finishing train 24, movement, collection and storage apparatuses of the rolled products.

Applicant has carried out experiments which prove that the endless process can allow the steel plant 10 to minimize discards, and consequently to obtain a yield, that is, the ratio between the weight of the finished metal product and the quantity of starting liquid steel, of more than 98%, even equal to or more than 99%.

In possible cases, wherein for example a steelworks must produce 1 Mt/year of finished metal product, that is from the rolling mill 12, a possible hourly productivity that must be guaranteed by the steel plant 10 can be about 150 t/h, taking into account said yield, the programmed stoppages and considering a normal annual cycle of about 6700 net production hours.

At the current moment, this kind of productivity cannot be obtained with a single co-rolling line, because for some sizes of product, typically used for the production of long metal products, the billets would have to be cast at speeds higher than 10 m/min, for example 12 m/min for a billet with a square section of 165 mm the side. This would make it impossible to obtain the solidification of the first skin in the ingot mold, and hence the product would be uncastable. It would also be impossible to control and manage the internal microstructure and hence the quality of the billets themselves and of the final product.

In this framework of needing to obtain high annual productivities, the present steel plant 10 includes at least the two co-rolling lines 100*a*, 100*b* described above.

Figure 2:
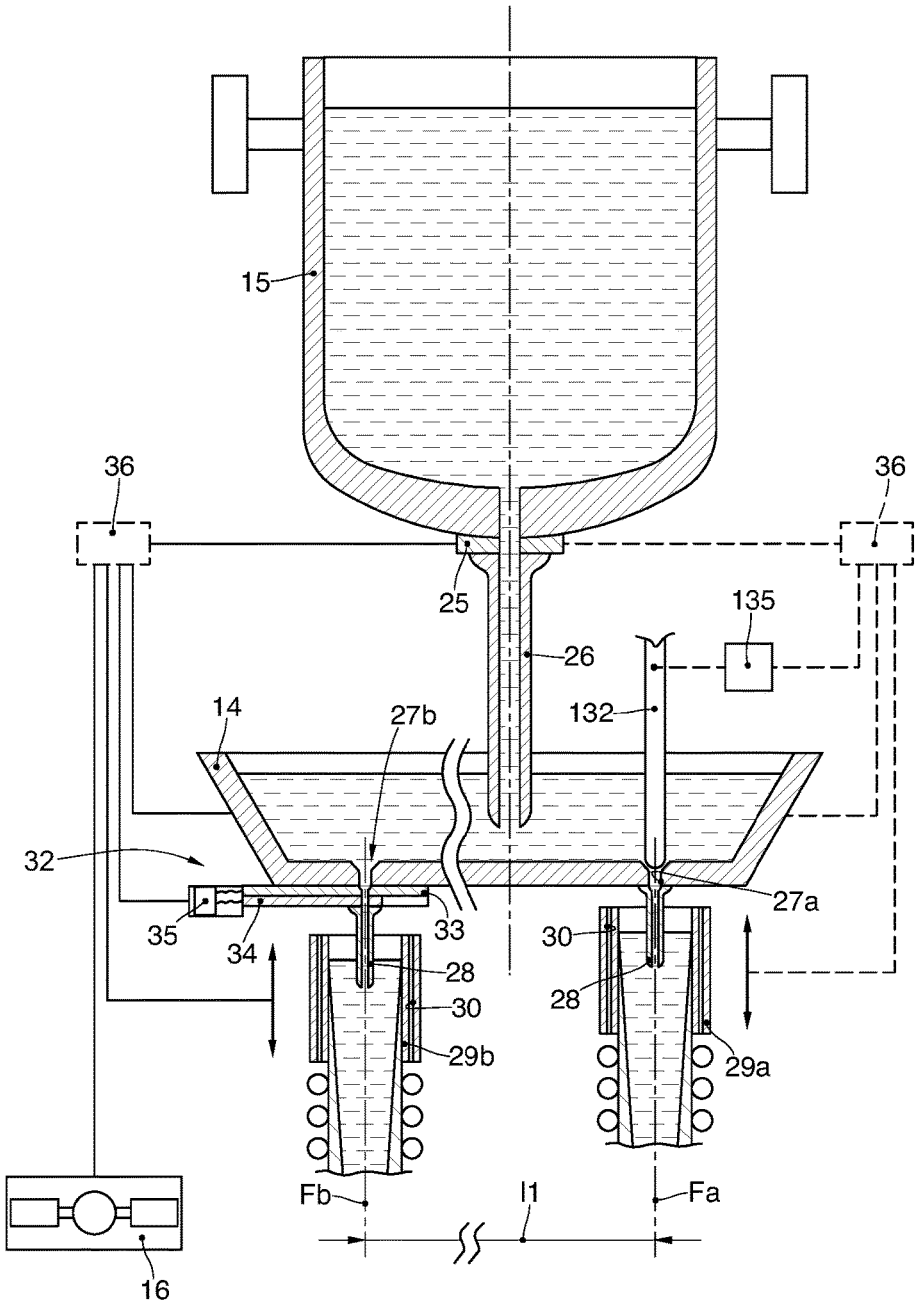
FIG. 2 is a front schematic view, partly sectioned, of a part of the plant in FIG. 1.

FIG. 2 is used to describe schematically possible forms of embodiment of the initial part of the continuous casting machine 11 which can comprise a ladle 15 configured to pour its content of molten metal into the single tundish 14, which in turn is configured to feed the two casting lines 11*a*, 11*b*.

In some forms of embodiment, a ladle box 25 can be provided, typically positioned on the bottom of the ladle 15, configured for the passage of the steel from the ladle 15 to the common tundish 14. The ladle box 25 can be positioned on the bottom of the ladle 15 and opened at the start of each individual casting and closed when the ladle 15 is empty or for example in the event of an emergency, if possible.

In possible implementations, the ladle box 25 can also be configured to regulate the stream of steel for the tundish 14 below the ladle 15.

In some forms of embodiment, an element to protect the stream can be provided, for example a discharger 26, positioned below the ladle box 25 and connected to the latter.

The discharger 26 is for example holed in through manner along a longitudinal direction, to define a channel for the passage of the stream of molten metal toward the tundish 14.

For example, the discharger 26 can be configured as a pipe, essentially tubular in shape, with an entrance and an exit at the two terminal ends, oblong in shape, which extends from the bottom of the ladle box 25 toward the tundish 14. For example, the discharger 26 can be made of ceramic refractory material.

With reference to FIG. 2, during use, the discharger 26 can be partly immersed in the liquid bath present in the tundish 14, so that the stream of steel from the ladle 15 to the tundish 14 is not in contact with the air.

The tundish 14, which as we said is alone for both casting lines 11*a*, 11*b*, has feed apertures on its bottom. The two casting lines 11*a*, 11*b* receive the molten steel from the tundish 14 autonomously through the feed apertures. In particular, a first feed aperture 27*a* may be provided, from which the steel destined for the first casting line 11*a* exits, and a second feed aperture 27*b*, from which the steel destined for the second casting line 11*b* exits.

The two feed apertures 27*a*, 27*b* are separated from each other by a distance that for example defines the line interaxis I1 of the casting lines 11*a*, 11*b*, at least in correspondence with the tundish 14.

The line interaxis I1 can be comprised between about 2,000 mm and about 5,000 mm, depending on the type of cast product and the type of casting equipment, as well as on the specific requirements and bulk of the rolling mill 12.

In the forms of embodiment described using FIG. 1, the co-rolling lines 100*a* and 100*b* are parallel to each other and the line interaxis I1 is constant along the plant axis X and defines the separation of the co-rolling lines 100*a*, 100*b* along the whole extension thereof, from the casting machine 11 to the rolling mill 12.

In this way it is possible to obtain a steel plant 10 with a multiple co-rolling line, for example with a double co-rolling line 100*a*, 100*b*, also being highly compact, since it allows to share between the two co-rolling lines 100*a*, 100*b* the management part and the sharing of the liquid steel.

The liquid steel arriving from the tundish 14 can be poured into crystallizers, for example respectively a first crystallizer 29*a* for the first casting line 11*a* and a second crystallizer 29*b* for the second casting line 11*b*, in which the solidification of the first skin of the billets occurs.

To this purpose, the crystallizers 29*a*, 29*b* can be cooled, for example by cooling circuits in which cooling liquid flows, for example water, such as for example one or more cooling channels 30 made axially in the thickness of the crystallizers 29*a*, 29*b*, or defined by hollow spaces. The cooling circuits and the delivery of cooling liquid that flows inside them are configured to remove the heat from the liquid steel, to cause rapid surface cooling and the consequent solidification of the outermost layer of the billet, for the formation of the so-called first skin.

To facilitate lubrication and the sliding of the billet along the internal wall of the corresponding crystallizer 29*a*, 29*b*, in some possible implementations it may be provided that the crystallizer 29*a*, 29*b* is configured to oscillate vertically (arrows in FIG. 2).

In possible forms of embodiment described using FIG. 2, dischargers or piston plungers 28 may be provided, to guide and protect the stream of steel from the tundish 14 to the crystallizer 29*a*, 29*b*. The dischargers or piston plungers 28 allow to eliminate turbulence in the stream of liquid steel.

In possible forms of embodiment, combinable with all the forms of embodiment described here, a regulation device may be provided, configured to regulate the stream of steel from the tundish 14 to the crystallizers 29*a*, 29*b* of the two casting lines 11*a*, 11*b*. For example, in possible implementations the regulation device can comprise a tundish box 32 (for example on the left in FIG. 2), or in other possible alternative implementations, the regulation device can comprise a stopper rod or stopper 132 (for example on the right in FIG. 2).

In the possible implementations where there is the tundish box 32 as regulation device, it may include a fixed holed plate 33, a mobile holed plate 34 and a command module 35. The command module 35 can be configured to move the mobile holed plate 34 with respect to the fixed holed plate 33 to vary the alignment of the respective holes and hence to define a feed channel that is consequently more or less large. The amplitude of the feed channel can depend on the casting speed to be obtained.

In the possible implementations where there is a stopper rod or stopper 132 as the regulation device, it can be mobile and can be connected to a command module 135 configured to control its height as a function of the casting speed to be obtained. The tip of the stopper rod or stopper 132 is brought near to or distanced from the corresponding feed aperture 27*a*, 27*b*, causing a greater or lesser occlusion thereof, and consequently opening a greater or lesser useful section for the passage of the liquid steel. The bigger the useful passage section, the greater is the stream of steel that passes from the tundish 14 to the casting lines 11*a*, 11*b*, and consequently the casting speed.

In possible forms of embodiment, combinable with all the forms of embodiment described here, the casting machine 11 can comprise a central management unit 36 of the electronic type, connected to and configured to control, command and manage, independently or combined, at least the part of the continuous casting machine 11 described using FIG. 2, for example the ladle box 25, the tundish boxes 32 or possibly the stoppers 132 (by means of the respective command modules 35, 135), the oscillations of the crystallizers 29*a*, 29*b*, and the extractor units 16.

It may be provided that each casting line 11*a*, 11*b* can be managed independently and autonomously with respect to the other casting line 11*b*, 11*a* by means of the central management unit 36

For example, it may be provided that the first casting line 11*a* can process billets at the same speed as the second line 11*b*, or that the billet in the first line 11*a* can be processed at a higher or lower casting speed than the billet in the second casting line 11*b*.

This need to vary the speeds between the casting lines 11*a*, 11*b* can be due to the need to obtain, at exit from the crystallizers 29*a*, 29*b*, billets that are different from each other, in sizes or microstructural characteristics, or to the need to work at different speeds in the rolling lines 12*a*, 12*b*, to obtain different finished products, or the fact that there is a need to deal with shortcomings or incidents occurring along one of the two co-rolling lines 100*a*, 100*b*.

Indeed it is possible that the central management unit 36 may intervene by setting variations to the speeds and the casting parameters of one or both the casting lines 11*a*, 11*b*, in response to variations in the rolling conditions of the respective rolling line 12*a*, 12*b*, or both rolling lines 12*a* and 12*b*.

In this way, it may be possible to obtain different finished products between the two co-rolling lines 100*a*, 100*b*, both processing different semifinished cast products and also processing identical semifinished cast products at different speeds.

These possibilities confer considerable operating flexibility on the steel plant 10 in question.

The steel plant 10 is given further flexibility by the fact that, if the productivity required is compatible with the productivity that can be supplied by a single co-rolling line 100*a*, 100*b*, for example up to 75 t/h, it may be possible to keep only one of the two co-rolling lines 100*a*, 100*b* active, in order to meet this requirement.

Keeping only one co-rolling line 100*a*, 100*b* active can also have the advantage of working on only one line in optimum speed conditions in order to obtain a quality finished product.

It is also possible, thanks to the presence of two co-rolling lines 100*a*, 100*b* with independent management, to equip one casting line 11*a*, 11*b*, or one rolling line 12*a*, 12*b*, while the other casting line 11*b*, 11*a* or rolling line 12*b*, 12*a* can proceed with its functioning. Furthermore, obligatory stoppages of one of the two co-rolling lines 100*a*, 100*b* can be made individually without stopping the production of the whole steel plant 10, as would happen in the case of a mono-line. In particular, if the rolling mill of one of the two co-rolling lines is stopped for maintenance or due to cobbles, the plant can function in two alternative modes.

a) The functioning line continues working normally, while the one with the rolling mill stopped continues to cast, producing billets which, instead of being sent to the respective rolling mill, are sheared to the desired length and discharged laterally downstream of the casting machine; in this way the cycle of the steel works upstream remains unchanged;

b) The production of the meltshop upstream is halved and only the functioning line is fed.

FIGS. 3 and 4 are used to describe forms of embodiment, combinable with all the forms of embodiment described here, in which at least one of the co-rolling lines 100*a*, 100*b*, at least for a segment thereof, in particular at least for the two casting lines 11*a*, 11*b*, is inclined with respect to a common median axis. In possible implementations this inclination can be an angle of inclination greater than 0° and up to 5°, in particular comprised between 0.5° and 3.5°, more particularly between 1° and 2°.

In possible forms of embodiment, both casting lines 11*a*, 11*b* are inclined with respect to the other, in particular they are reciprocally divergent on a horizontal plane with respect to the cited common median axis, and define respective different work directions Fa and Fb, inclined, in particular divergent, with respect to each other.

This inclination, in particular divergence, can be advantageous since it allows to provide a minimum distance between the two casting lines 11*a*, 11*b* at the tundish 14, so that the latter is as compact as possible, and a greater distance between the successive rolling lines 12*a*, 12*b*, sufficient for example to allow maintenance, replacement, extraction operations or suchlike, on the units or groups that make up the two co-rolling lines 100*a*, 100*b*, also operating inside the latter.

With reference to FIGS. 3 and 4, forms of embodiment are described by way of example in which the two casting lines 11*a*, 11*b* are both inclined in a reciprocally specular manner with respect to the plant axis X.

Solutions can also be provided in which the casting lines 11*a*, 11*b* are asymmetrically inclined with respect to the plant axis X, or solutions in which only one of the casting lines 11*a*, 11*b* is inclined and one is parallel to the plant axis X.

As a possible consequence, if the casting lines 11*a*, 11*b* are reciprocally inclined, also the rolling lines 12*a*, 12*b* are reciprocally inclined, and if the casting lines 11*a*, 11*b* are parallel, so then too the rolling lines 12*a*, 12*b* are parallel.

According to possible implementations, described with reference to FIG. 3 for example, the rolling lines 12*a*, 12*b* can be reciprocally inclined in the work directions Fa and Fb only for a limited segment or tract of their extension, for example comprised between the feed segment 20 of the induction furnaces 21 and the roughing train 22, or between the feed segment 20 and the intermediate train 23, the remaining segment being parallel to the plant axis X.

Other solutions, described with reference to FIG. 4, can provide that the co-rolling lines 100*a*, 100*b* are defined by casting lines 11*a*, 11*b* reciprocally diverging and by rolling lines 12*a*, 12*b* parallel to each other.

In forms of embodiment with divergent co-rolling lines 100*a*, 100*b*, described for example using FIGS. 3 and 4, a second line interaxis I2 is determined, in correspondence with the finishing train 24, bigger than the first line interaxis I1 between the feed apertures 27*a*, 27*b* of the tundish 14.

The second line interaxis I2 is configured to allow to house the rolling apparatuses astride the respective rolling lines 12*a*, 12*b*, and also to move the components that have to be removed in order to perform equipping and maintenance of the rolling lines 12*a*, 12*b*, for example the calibration cylinders.

According to some forms of embodiment, the length of the second line interaxis I2 can be bigger at least between 100% and 300% more than the length of the first line interaxis I1, for example at least 100% more, in particular at least 150% more, more in particular at least 200% more, even more in particular at least 250% more, also up to 300% more, or more, than the length of the first line interaxis I1, depending on the specific design and/or operating requirements.

The present invention also concerns a method for the production of long metal products, comprising continuous casting and rolling downstream of the continuous casting, which provides:

- to supply molten metal from the tundish 14 to the two co-rolling lines 100*a*, 100*b* disposed adjacent along the respective work directions F, Fa, Fb;
- to cast the molten metal received from the tundish 14 along the two adjacent casting lines 11*a*, 11*b* of the co-rolling lines 100*a*, 100*b;*
- to roll the cast metal received from the two casting lines 11*a*, 11*b* along at least two adjacent rolling lines 12*a*, 12*b* of the co-rolling lines 100*a*, 100*b*.

In possible implementations of the method described here, the two co-rolling lines 100*a*, 100*b* can be configured to produce long metal products according to the present description, which are made different from each other from the two co-rolling lines 100*a*, 100*b* in terms at least of the section shape and/or section area.

It is clear that modifications and/or additions of parts may be made to the steel plant 10 as described heretofore, without departing from the field and scope of the present invention.

It is also clear that, although the present invention has been described with reference to some specific examples, a person of skill in the art shall certainly be able to achieve many other equivalent forms of steel plant, having the characteristics as set forth in the claims and hence all coming within the field of protection defined thereby.

The invention claimed is:

1. Steel plant for production of long metal products, said steel plant comprising:

a continuous casting machine and a rolling mill disposed contiguous and in direct succession downstream of the continuous casting machine, in which the continuous casting machine is provided with at least two casting lines and the rolling mill is provided with at least two rolling lines, wherein each casting line is aligned with a respective rolling line defining overall at least two co-rolling lines disposed adjacent along respective work directions, and wherein each of the at least two rolling lines includes its own roughing rolling train, its own intermediate rolling train, and its own finishing rolling train, a single molten metal feed apparatus, said at least two casting lines being configured to receive molten metal from said single molten metal feed apparatus, and a central management unit connected to an extractor unit of each of said at least two casting lines and to a regulation device to regulate a stream of molten metal from said single molten metal feed apparatus to a corresponding crystallizer of each of said at least two casting lines, said central management unit being configured to independently and autonomously control each of the extractor units and the regulation device so as to selectively vary a casting speed of each casting line, independently and autonomously with respect to the at least one other casting line.

2. Steel plant as in claim 1, and further comprising a transfer path for semifinished cast products from the casting machine to the rolling mill, configured to connect each of said casting lines to a corresponding rolling line.

3. Steel plant as in claim 1, wherein said single molten metal feed apparatus is configured to feed said at least two casting lines through corresponding feed apertures separated from each other by a distance defining a first line interaxis between said at least two casting lines.

4. Steel plant as in claim 3, wherein said at least two co-rolling lines are separated from each other, in correspondence with a terminal zone of said rolling mill, by a distance equal to a second line interaxis, bigger than said first line interaxis.

5. Steel plant as in claim 4, wherein the length of said second line interaxis is bigger than the length of said first line interaxis at least by 100%.

6. Steel plant as in claim 1, wherein said at least two co-rolling lines are parallel to each other in a common work direction.

7. Steel plant as in claim 1, wherein said at least two co-rolling lines are divergent to each other on a plane horizontal to a common median axis at least near said at least two casting lines.

8. Steel plant as in claim 7, wherein said at least two co-rolling lines are oriented in work directions reciprocally inclined and divergent starting from said single molten metal feed apparatus.

9. Steel plant as in claim 1, wherein the at least two rolling lines are parallel.

10. Method for production of long metal products, comprising continuous casting and rolling downstream of the continuous casting, comprising:

supplying molten metal from a single molten metal feed apparatus to at least two co-rolling lines disposed adjacent along respective work directions;

casting the molten metal received from the single molten metal feed apparatus along at least two adjacent casting lines of the co-rolling lines;

rolling the cast metal received from the at least two casting lines along at least two adjacent rolling lines of the co-rolling lines, wherein each of the at least two adjacent rolling lines includes its own roughing rolling train, its own intermediate rolling train, and its own finishing rolling train;

independently and autonomously controlling, through a central management unit, the functioning of an extractor unit of each of said at least two casting lines and of a regulation device of a stream of molten metal from said feed apparatus to a corresponding crystallizer of each of said two casting lines, in order to selectively vary a casting speed of each casting line, independently and autonomously with respect to the at least one other casting line.

* * * * *